US008833740B2

(12) United States Patent
Ha

(10) Patent No.: US 8,833,740 B2
(45) Date of Patent: Sep. 16, 2014

(54) NATURAL EVAPORATION TYPE HUMIDIFIER AND AIR CONTROL DEVICE HAVING THE SAME

(75) Inventor: Che Hub Ha, New Hyde Park, NY (US)

(73) Assignee: Che Hub Ha, New Hyde Park, NY (US)

( * ) Notice: Subject to any disclaimer, the term of this patent is extended or adjusted under 35 U.S.C. 154(b) by 649 days.

(21) Appl. No.: 13/168,363

(22) Filed: Jun. 24, 2011

(65) Prior Publication Data

US 2012/0326340 A1 Dec. 27, 2012

(51) Int. Cl.

| | |
|---|---|
| ***F24F 3/14*** | (2006.01) |
| ***B01F 3/04*** | (2006.01) |
| ***F24F 6/04*** | (2006.01) |
| *F24F 6/00* | (2006.01) |

(52) U.S. Cl.

CPC ..... *F24F 6/043* (2013.01); *F24F 2006/008* (2013.01)

USPC ..... 261/104; 261/154; 261/107

(58) Field of Classification Search

CPC ..... F24F 6/043; F24F 2006/008

USPC ..... 261/154

See application file for complete search history.

(56) References Cited

U.S. PATENT DOCUMENTS

| | | | | | |
|---|---|---|---|---|---|
| 1,281,390 | A | * | 10/1918 | Kelling | 239/44 |
| 1,369,775 | A | * | 3/1921 | Bliss | 237/78 R |
| 1,490,682 | A | * | 4/1924 | Stitt | 239/50 |
| 1,719,569 | A | * | 7/1929 | Steele | 239/43 |
| 1,961,711 | A | * | 6/1934 | Rosenow | 261/104 |
| 2,068,431 | A | * | 1/1937 | Patterson | 261/106 |
| 2,173,073 | A | * | 9/1939 | Pierson | 261/30 |
| 2,590,301 | A | * | 3/1952 | Ellis | 239/44 |
| 2,678,235 | A | * | 5/1954 | Perlman | 239/44 |
| 2,749,725 | A | * | 6/1956 | Essman et al. | 62/281 |
| 2,847,989 | A | * | 8/1958 | Powers et al. | 126/113 |
| 2,914,308 | A | * | 11/1959 | Bock, Jr. | 261/104 |
| 3,276,754 | A | * | 10/1966 | Skerritt | 261/104 |
| 3,400,919 | A | * | 9/1968 | Schall | 261/102 |
| 3,757,082 | A | * | 9/1973 | Goicoechea | 392/403 |
| 4,226,174 | A | * | 10/1980 | Vesper | 454/328 |
| 4,706,552 | A | * | 11/1987 | Maguire | 454/291 |
| 4,782,627 | A | * | 11/1988 | Hauk | 47/81 |
| 5,324,230 | A | * | 6/1994 | Hist | 454/328 |
| 6,850,698 | B1 | * | 2/2005 | Goh | 392/403 |

FOREIGN PATENT DOCUMENTS

| | | | | | |
|---|---|---|---|---|---|
| GB | 1465245 | A | * | 2/1977 | |
| GB | 2070966 | A | * | 9/1981 | F24F 3/14 |
| GB | 1600027 | A | * | 10/1981 | |

* cited by examiner

*Primary Examiner* — Duane Smith
*Assistant Examiner* — Stephen Hobson
(74) *Attorney, Agent, or Firm* — Lowe Hauptman & Ham, LLP

(57) ABSTRACT

A natural evaporation type humidifier includes a reservoir for containing liquid, an absorbent member for absorbing the liquid in the reservoir by capillary action, and a supporter for supporting the absorbent member. The supporter is detachably assembled with the reservoir and has a portion extended away from the reservoir to guide the absorbent member to a position outside the reservoir.

20 Claims, 13 Drawing Sheets

NATURAL EVAPORATION TYPE HUMIDIFIER AND AIR CONTROL DEVICE HAVING THE SAME

TECHNICAL FIELD

The disclosure relates to a humidifier and an air control or conditioning device, and more particularly to a humidifier for humidifying air by natural evaporation of liquid, and an air control or conditioning device including the humidifier.

BACKGROUND

It is important to maintain proper humidity levels in a house especially during cold and dry seasons wherein the house is heated. As the house heats up the air in it can easily become dry. A wide variety of humidifiers have been utilized for conditioning air by increasing the humidity. There are several types of mechanical humidifiers. For example, steam humidifiers boil water and release steam and moisture into the air. These thus require significant energy for boiling the water. Impeller humidifiers utilize a fast rotating disk in combination with a comb to liberate large droplets of water and break the droplets into smaller diffusible droplets that float into the air. Ultrasonic humidifiers use a piezoelectric transducer to transform electrical energy into mechanical energy for generating a cool fog. However, water droplets in the cool fog generated by the ultrasonic humidifiers may allow white dust comprising small amounts of water born contaminants including minerals to precipitate onto the floor and the like, thereby creating a dusty white coating on horizontal surfaces. Further, too much moisture enforced by the ultrasonic humidifiers can cause mold to grow. An example of conventional type evaporative humidifiers uses a wick positioned in a water source, and a motorized fan positioned adjacent to the wick for blowing air onto the wick to aid in the evaporation of the water therein. The water migrates along the wick by capillary action and evaporates into the air. However, the wick can be breeding grounds for bacteria and can allow mineral deposits to settle over time if it is not properly maintained, cleaned and stored. Moreover, the fan requires electric power source for its driving, and may also cause irritating noises.

SUMMARY

Example embodiments of the invention include a natural evaporation type humidifier comprising a reservoir for containing liquid, an absorbent member for absorbing the liquid in the reservoir by capillary, and a supporter for supporting the absorbent member. The supporter is detachably assembled with the reservoir and extends away from the reservoir to guide the absorbent member to a position outside the reservoir.

Example embodiments of the invention also include an air control device comprising a natural evaporation type humidifier, and a heater for generating heat. The humidifier comprises a reservoir for containing liquid, an absorbent member for absorbing the liquid in the reservoir by capillary action, and a supporter for supporting the absorbent member. The reservoir is positioned on the heater so as to heat the liquid in the reservoir. The supporter is detachably assembled with the reservoir and extends away from the reservoir to guide the absorbent member to face the heater at a location outside the reservoir.

Example embodiments of the invention include a natural evaporation type humidifier comprising means for containing liquid, means for absorbing the liquid in the containing means by capillary action, and means for supporting the absorbing means. The supporting means is detachably assembled with the containing means and extends away from the containing means to guide the absorbing means to a position outside the containing means.

Example embodiments of the invention include an air control device comprising means for generating heat, means for containing liquid, means for absorbing the liquid in the containing means by capillary action, and means for supporting the absorbing means. The containing means is placed on the generating means. The supporting means is detachably assembled with the containing means and extends away from the containing means to guide the absorbing means to a position wherein it faces the generating means at a location outside the containing means.

BRIEF DESCRIPTION OF THE DRAWINGS

The following disclosure is taken in conjunction with the accompanying drawings, in which.

DETAILED DESCRIPTION

Figure 1:
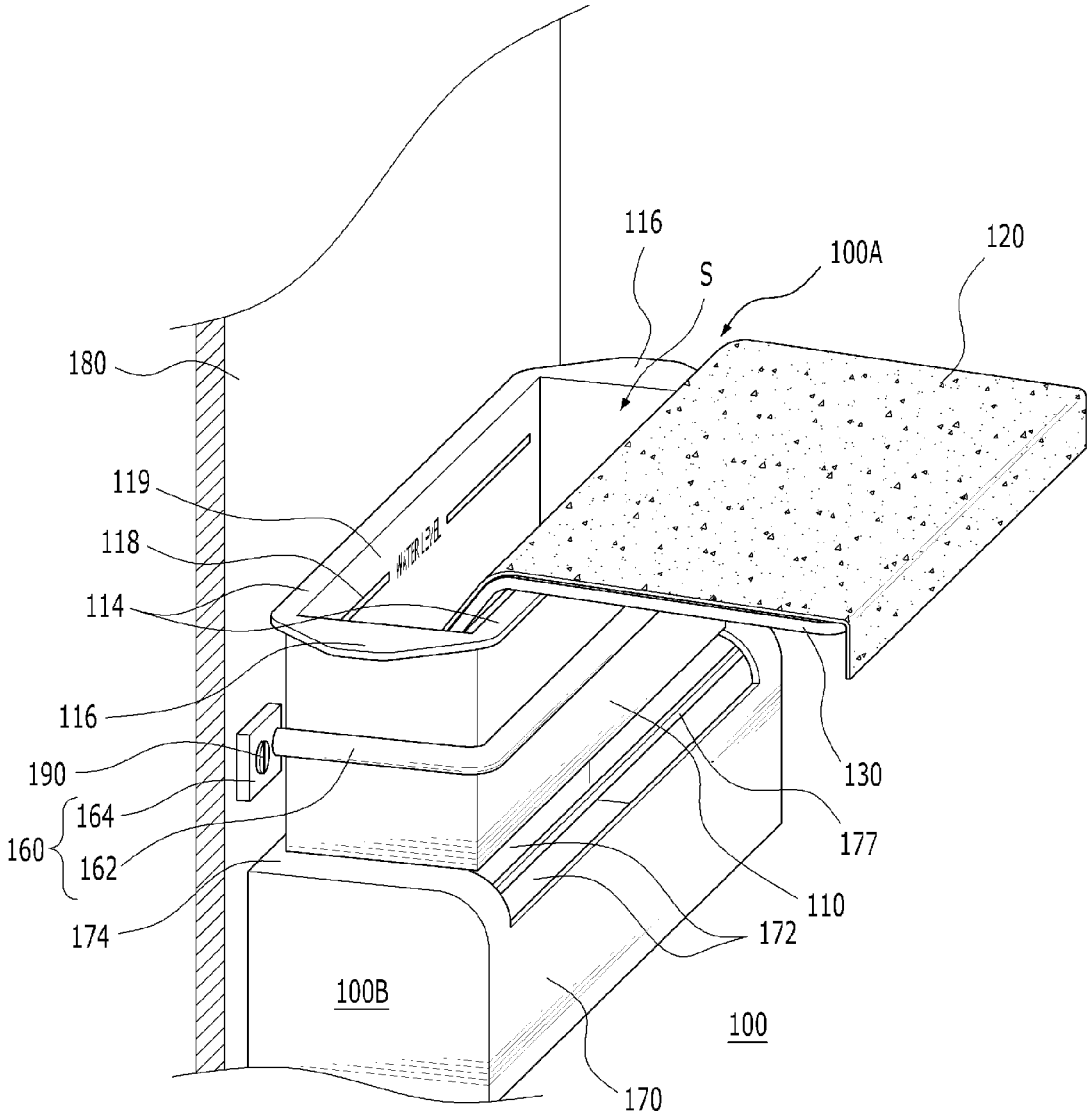
FIG. 1 is a schematic perspective view of an exemplary air control device including a humidifier according to some embodiments.

The fabrication and use of various embodiments are discussed in detail below with reference to the accompanying drawings, in which exemplary embodiments of the inventive concept are shown. The inventive concept may, however, be embodied in many different forms and should not be construed as being limited to the embodiments set forth herein; rather, these embodiments are provided so that this description will be thorough and complete, and will fully convey the inventive concept to those of ordinary skill in the art. It will be apparent, however, that one or more embodiments may be practiced without these specific details.

In the drawings, the thicknesses and widths of layers and regions are exaggerated for clarity. Like reference numerals in the drawings denote like elements. The elements and regions illustrated in the figures are schematic in nature, and thus relative sizes or intervals illustrated in the figures are not intended to limit the scope of the inventive concept.

Figure 2:
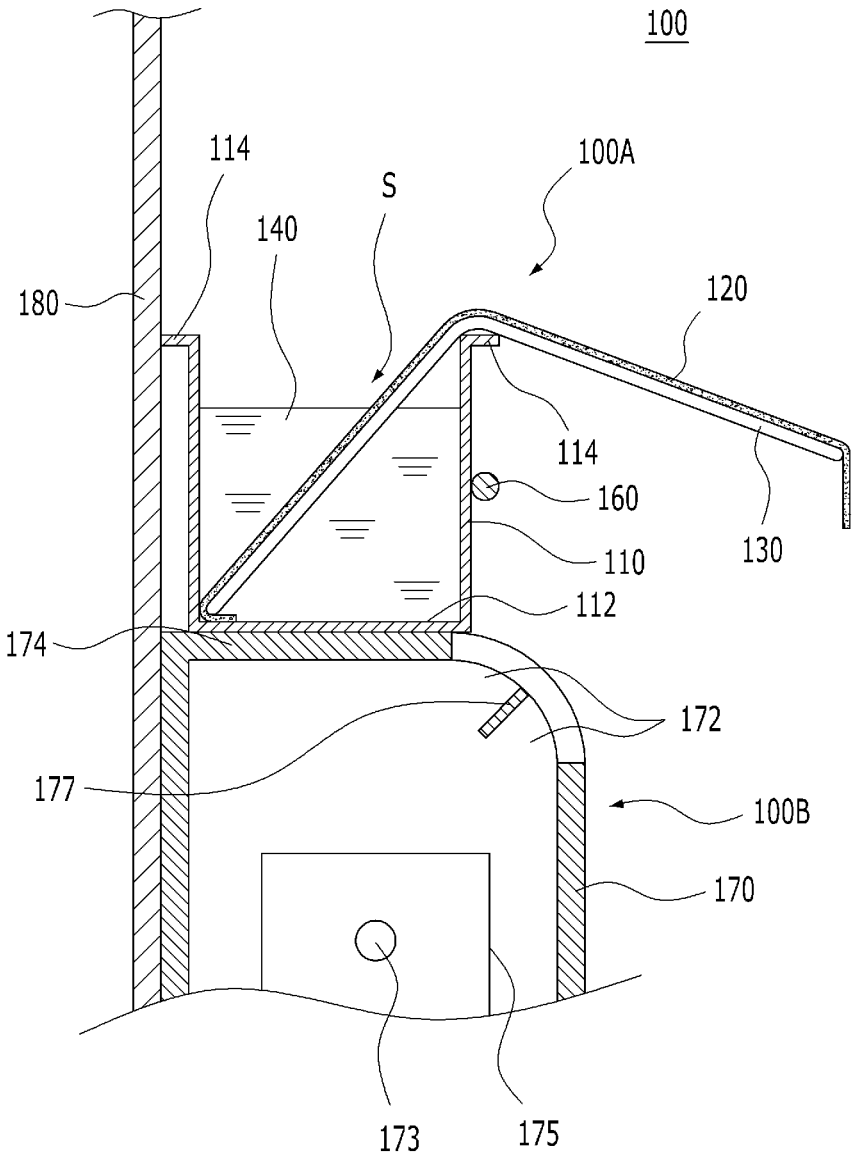
FIG. 2 is a sectional side view of an exemplary air control device including a humidifier according to some embodiments.
Figure 3:
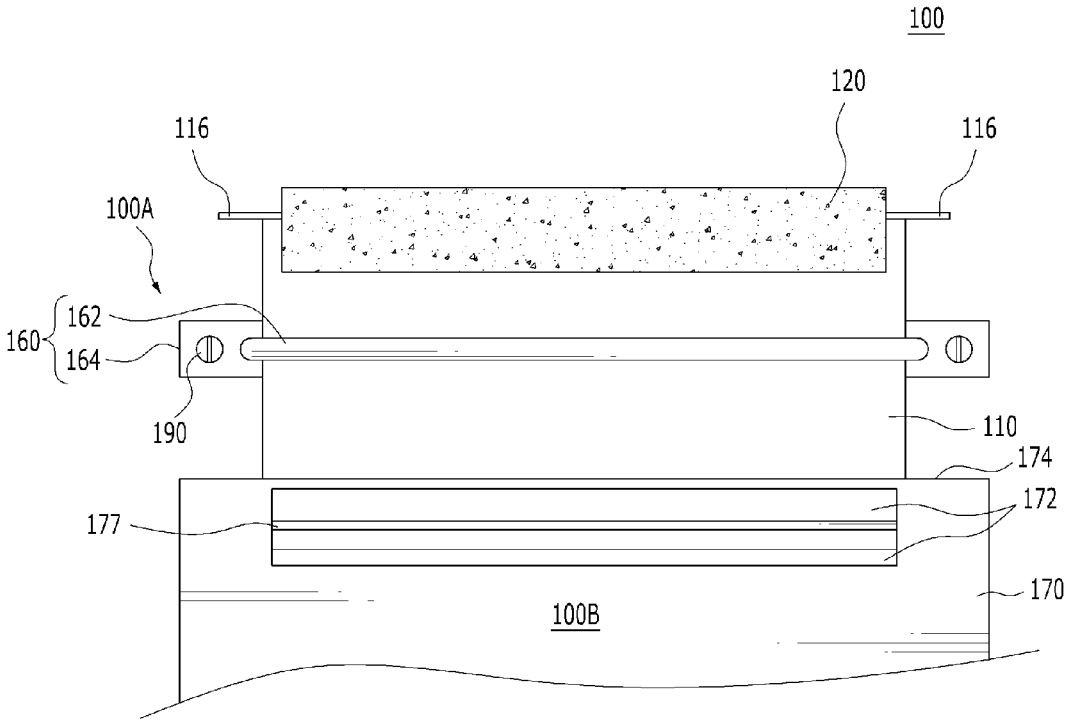
FIG. 3 is a front view of an exemplary air control device including a humidifier according to some embodiments.

Referring to FIGS. 1-3, an air control device 100 comprises a natural evaporation type humidifier 100A for humidifying air in a room, and a heater 100B for generating heat. The humidifier 100A comprises a reservoir 110, an absorbent member 120, and a supporter 130. The reservoir 110 has an inner space S for receiving liquid 140, for example water, and storing the liquid 140 therein. The absorbent member 120 is supported by the supporter 130. The absorbent member 120 absorbs the liquid 140 contained in the reservoir 110 by capillary action when a portion of the absorbent member 120 is dipped/immersed into the liquid 140.

The supporter 130 supports the absorbent member 120 when the supporter 130 is assembled (viz., disposed in the illustrated operative position) with the reservoir 110. The supporter 130 is, as will be understood, detachably assembled with the reservoir 110 and has a portion configured to extend away from the reservoir 110 to guide the absorbent member 120 out and away from the reservoir 110. As can be seen from FIG. 2, the supporter 130 is held in a tilted position within the reservoir 110 when the supporter 130 is in its assembled position. In this assembled position, the supporter 130 is seated in a stable position while resting against walls of the reservoir 110. For example, the supporter 130 is positioned to rest against the inner walls near bottom edges of the reservoir 110 and/or top edges of the reservoir 110 at the entrance thereof. Alternatively, the supporter 130 is assembled with the reservoir 110 by using a holding means such as a hook member 220. The hook member 220 for holding the supporter 130 will be discussed in more detail later referring to embodiments shown in FIGS. 9A-9D.

By dipping a part of the absorbent member 120 into the liquid 140 contained in the reservoir 110, the absorbent member 120 absorbs the liquid 140 by capillary action and the liquid 140 spreads through the entire absorbent member 120. The liquid 140 absorbed into the absorbent member 120 naturally evaporates from the surface of the absorbent member 120 due to convection or other movement of the air in the room where the humidifier 100A is provided, and humidifies the room.

In some embodiments, the reservoir 110 is formed of a water repellent (hydrophobic) material. In some embodiments, the reservoir 110 is formed of a transparent, translucent, or opaque material. For example, the reservoir 110 is made of at least one of glass such as a tempered soda lime glass, metals such as a stainless steel, heat-resistant plastics, or ceramic materials.

In some embodiments, the absorbent member 120 is a flexible water-absorbent sheet made of at least one of natural fabrics, synthetic fabrics, synthetic resins, non-woven fabrics, or paper. The synthetic resins comprise a micro porous web with a plurality of pores. The synthetic resins are selected from the materials such as polyester resins and phenol resins, each of which is lightweight and resistant to friction. In some embodiments, an affordable and durable towel is used as the absorbent member 120. The material of the absorbent member 120 is not limited to the above mentioned. Any material which can absorb and evaporate liquid can be adopted as a material for the absorbent member 120. The absorbent member 120 may further comprise antibacterial agents or fungicide mixed with the fabric or resin in order to prevent appearance of various germs or mold in a water-soaked or damp condition.

In some embodiments, the supporter 130 is made of metal or plastic material. In some embodiments, the supporter 130 is formed of stainless steel, nonferrous metal, or antimicrobial treated plastic.

The heater 100B is, in the disclosed embodiments, arranged near a vertical wall 180 of the room. Further, the humidifier 100A is arranged on a heater body 170 of the heater 100B. In one embodiment, the heater 100B includes a thin elongated metal pipe 173, through which hot water flows, and a series of fins 175 which are in good thermal contact with the metal pipe 173. The metal pipe 173 penetrates through aligned apertures formed in the fins 175. The heat generated from the metal pipe 173 flows to the fins 175, and is radiated through the fins 175. The metal pipe 173 can be made of copper, and the fins 175 can be made of aluminum. In one embodiment, the heater 100B includes a deflector portion 177 for regulating flow of the heated air. The reservoir 110 is positioned directly on the heater body 170 of the heater 100B. In some embodiments, the temperature of the heater 100B is higher than that of the reservoir 110, and the heat from the heater 100B is transferred to the reservoir 110, thereby increasing the temperature of the reservoir 110. For example, the heater 100B is a baseboard radiator having outlet openings 172 formed in the heater body 170 for discharging heated air from the heater body 170.

When the supporter 130 is in its assembled position with the reservoir 110, a part of the supporter 130, e.g. an upper portion of the supporter 130 is arranged with the outlet openings 172 so that a predetermined distance is provided between the upper portion of the supporter 130 and the outlet openings 172.

In some embodiments, the heat from the heater 100B is partially conducted through a top wall 174 of the heater body 170 and a bottom wall 112 of the reservoir 110. In this case, the partially conducted heat is transferred to the liquid 140 contained in the reservoir 110. The liquid 140 is absorbed into the absorbent member 120 by capillary action, thereby promoting evaporation of the liquid 140. The liquid 140 which is spread through the entire portion of the absorbent member 120 is more efficiently evaporated into the ambient air by the heat directly discharged from the outlet openings 172 to the absorbent member 120 that spans over the upper portion of the supporter 130 outside of the reservoir 110. This is because the absorbent member 120 supported on the upper portion of the supporter 130 is faced toward the outlet openings 172 and the heated air discharged from the outlet openings 172 causes active air flow by means of convection. As a result, vigorous evaporation of the liquid from the absorbent member 120 is achieved by means of the air flow around the absorbent member 120, and the evaporated moisture is uniformly distributed within the room by means of the convection caused by the heat discharged from the outlet openings 172. The room therefore tends to be uniformly humidified.

The humidifier 100A accordingly does not need a separate electric power and requires little or no maintenance for humidifying the room but enables natural evaporation without noise using a heat generated from the heater 100B which is inevitably used during the heating season. Therefore, the humidifier 100A can be manufactured at a low cost while having sufficient natural humidifying capability.

In some embodiments, the reservoir 110 has a pair of wings 114 protruded from a front side edge and a rear side edge of the reservoir 110, respectively, at an entrance portion of the reservoir 110. The pair of wings 114 can enhance intensity of stress in the reservoir 110. Further, the reservoir 110 has a pair of handles 116 protruded from both side edges of the reservoir 110 proximate the entrance portion of the reservoir 110.

In some embodiments, the humidifier 100A further comprises a retainer 160 for supporting the reservoir 110. In some embodiments, the pair of handles 116 has a size suitable for grasping by a user when the reservoir 110 is to be inserted into or removed from the retainer 160, or the reservoir 110 is to be cleaned.

As illustrated in FIGS. 1-3, the bottom wall 112 of the reservoir 110 directly contacts with the top wall 174 of the heater body 170. Alternatively, the bottom wall 112 of the reservoir 110 can be spaced apart from the top wall 174 of the heater body 170 according to a level at which the retainer 160 should be fixed to the vertical wall 180. In this case, the retainer 160 is fixed to the vertical wall 180 at a relatively high level so that the retainer 160 supports one of the pair of wings 114 of the reservoir 110 and the pair of handles 116, and therefore the reservoir 110 is maintained at a fixed level by means of the retainer 160. As illustrated in FIG. 1, the reservoir 110 may have a reference mark 118 on the inner wall 119 of the reservoir 110. The reference mark 118 may be marked on opposite inner walls facing each other. For instance, the reference mark 118 indicates a preferable maximum liquid level in the reservoir 110.

Figure 4A:
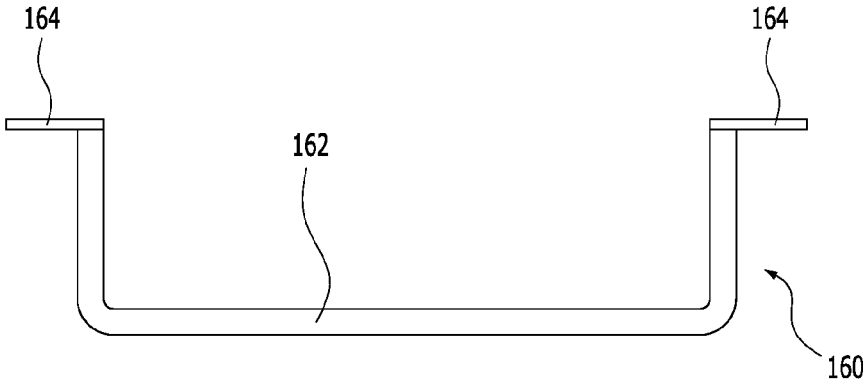
FIG. 4A is a plan view of a retainer of an exemplary humidifier according to some embodiments.
Figure 4B:
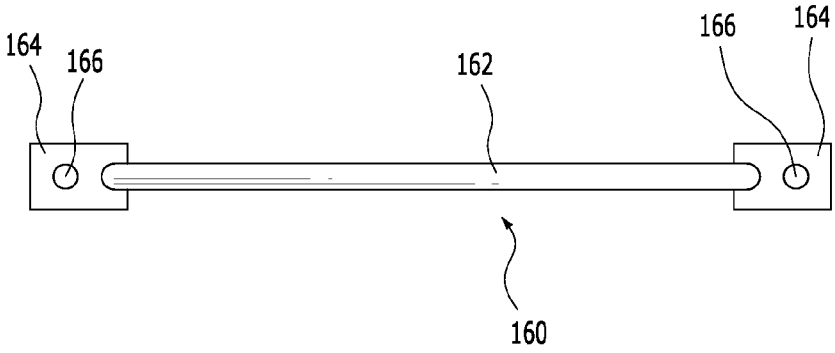
FIG. 4B is a front view of a retainer of an exemplary humidifier according to some embodiments.
Figure 4C:
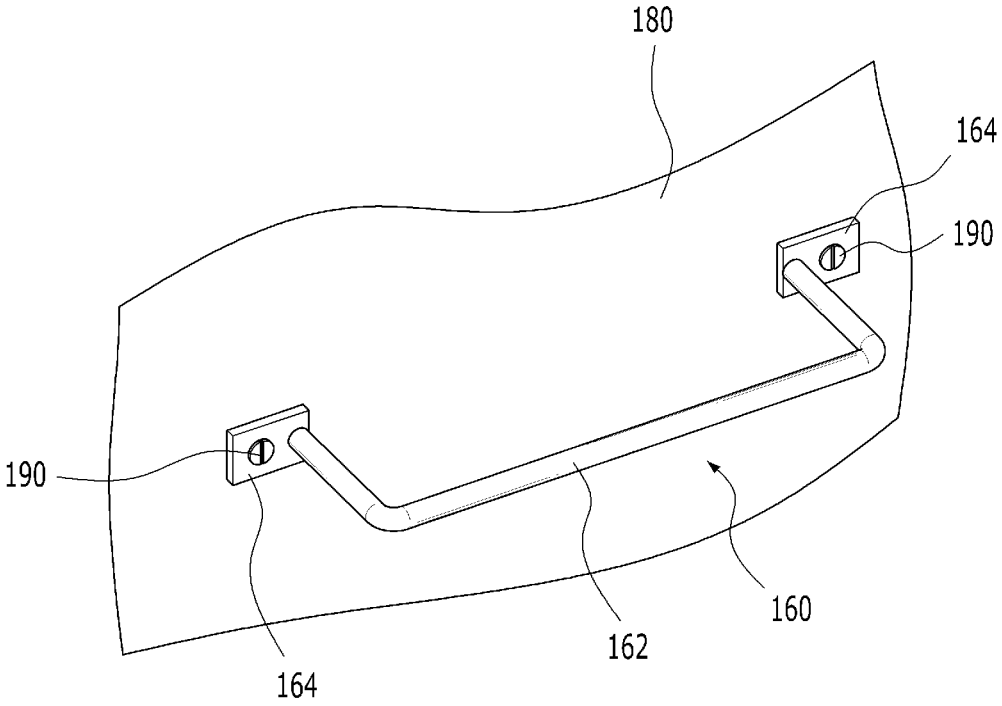
FIG. 4C is a perspective view of a retainer of an exemplary humidifier according to some embodiments.

In some embodiments, the retainer 160 includes a belt portion 162 and fixing ends 164 integrally connected to the belt portion 162, as shown in FIGS. 4A-4C. The belt portion 162 holds the reservoir 110 and prevents the reservoir 110 from escaping from its position on the top wall 174. In some embodiments, the belt portion 162 supports the reservoir 110 at a predetermined level of the vertical wall 180 of the room. The retainer 160 is fixed to the vertical wall 180 by means of the fixing ends 164. Holes 166 are formed approximately at the center of the fixing ends 164. As shown in FIG. 4C, the retainer 160 may be fixed to the vertical wall 180 by tightening fixing devices 190, for example screws through the holes 166. In some embodiments, the retainer 160 is made of metal or plastic material. In some embodiments, a metal pipe such as a stainless steel or nonferrous steel pipe is used in order to form the retainer 160. For example, both ends of the metal pipe sequentially undergo a thermo compression or cold compress process and a punching process to form the fixing ends 164 having the holes 166. The metal pipe then undergoes a bending process for bending the metal pipe to form desired configuration of the retainer 160, as shown in FIG. 4C.

Figure 5:
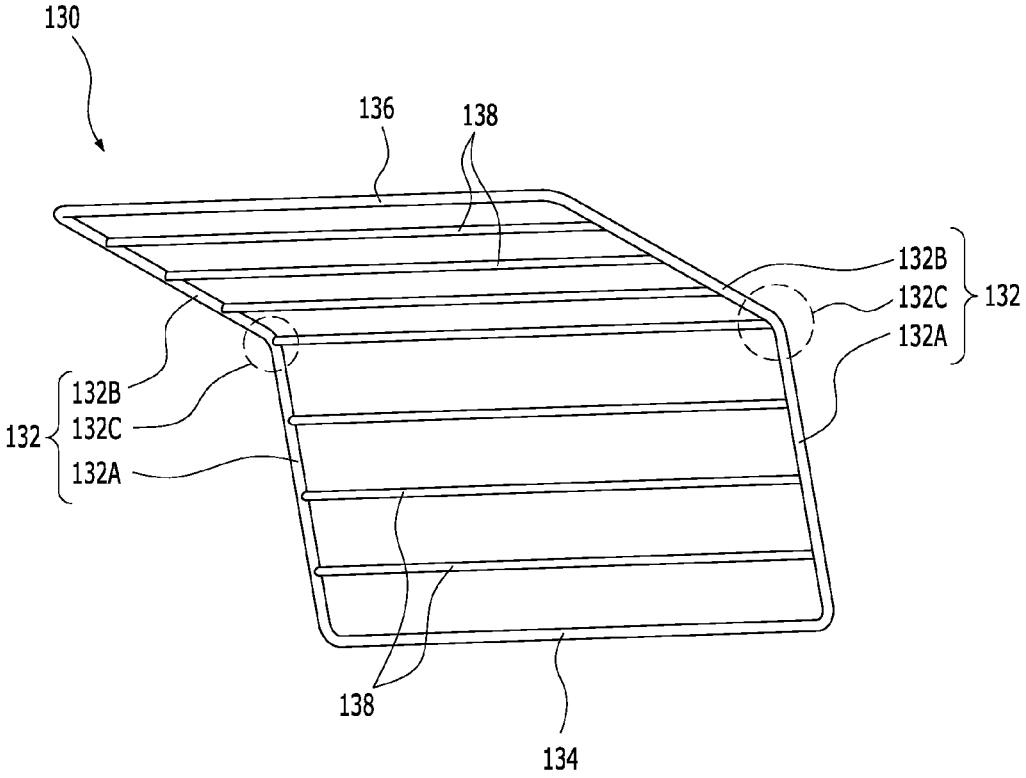
FIG. 5 is a perspective view of a supporter of an exemplary humidifier according to some embodiments.

In some embodiments, the supporter 130 includes a pair of side frames 132, a bottom frame 134, and a top frame 136, as shown in FIG. 5. The pair of side frames 132 is extended from inside of the reservoir 110 out of the reservoir 110 when the supporter 130 is in its assembled position. Each of the side frames 132 includes a lower side frame 132A, an upper side frame 132B, and a bent portion 132C. The lower side frame 132A is extended within the reservoir 110 along a first direction when the supporter 130 is in its assembled position. The upper side frame 132B is extended away from the reservoir 110 along a second direction different from the first direction when the supporter 130 is in its assembled position. The bent portion 132C connects the lower side frame 132A and the upper side frame 132B. As illustrated in FIG. 5, the upper side frame 132B may be extended in a straight line.

The supporter 130 further includes a plurality of guide wires or rods 138. The plurality of guide wires 138 supports and guides the absorbent member 120 when the supporter 130 is in its assembled position. The plurality of guide wires 138 has both ends connected to the pair of side frames 132, respectively, between the pair of side frames 132. The plurality of guide wires 138 may be extended perpendicular to the pair of side frames 132. The plurality of guide wires 138 may be extended in a straight line as illustrated in FIG. 5.

The bottom frame 134 of the supporter 130 may be seated in a stable position while resting against the inner walls of the reservoir 110 near a bottom edge of the reservoir 110 when the supporter 130 is in its assembled position. Further, as illustrated in FIG. 2, a part of the absorbent member 120 may be pinched (wedged) between the bottom frame 134 and the inner walls of the reservoir 110 when the supporter 130 is in its assembled position.

Figure 6:
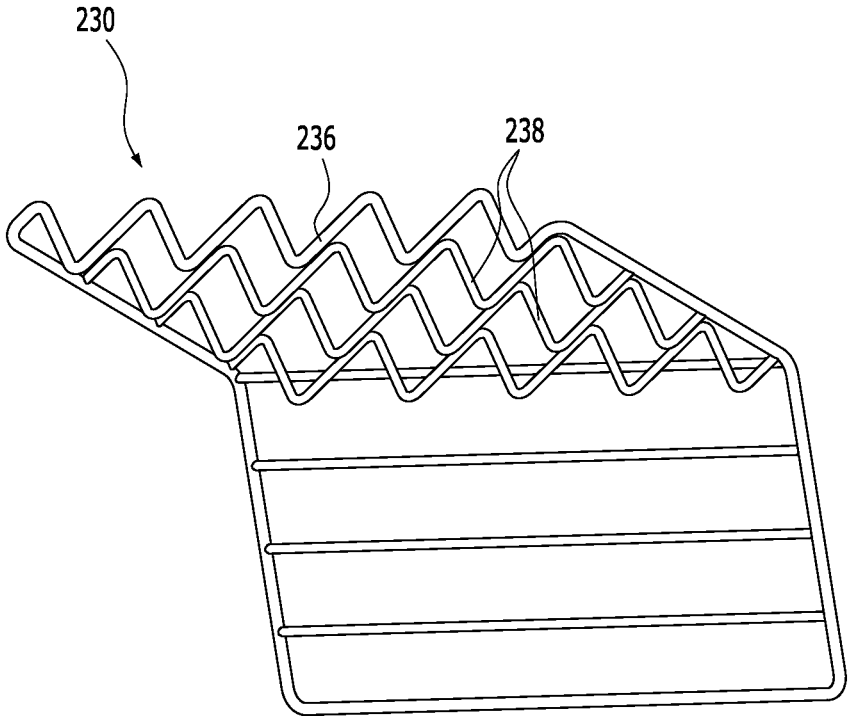
FIG. 6 is a perspective view showing an alternative supporter of an exemplary humidifier according to some embodiments.

According to some embodiments, at least one of the guide wires 138, the bottom frame 134, and the top frame 136 can be formed so as to have a zigzag configuration, as desired. FIG. 6 illustrates a supporter 230 as an alternative example of the supporter 130 according to some embodiments. In FIG. 6, some of the guide wires 238 and a top frame 236 are extended in a zigzag configuration. In this configuration, top surfaces of the guide wires 238 have a rough or uneven contour by means of the zigzag shape of the guide wires 238. Therefore, when the absorbent member 120 is spread on the supporter 230, the absorbent member 120 can deform along the uneven contour of the top surfaces of the guide wires 238 to be alternatively folded, and form an uneven sheet having a corrugated shape. As a result, a relatively large sized absorbent member can be used as the absorbent member 120, and therefore relatively large surface area for humidifying can be obtained.

Figure 7:
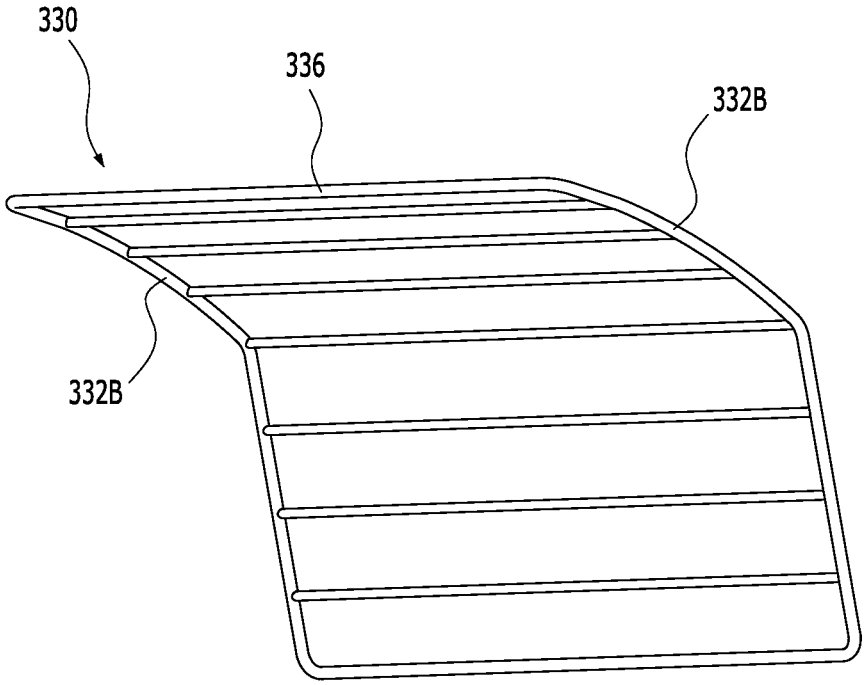
FIG. 7 is a perspective view showing another alternative supporter of an exemplary humidifier according to some embodiments.

FIG. 7 illustrates a supporter 330 as another alternative example of the supporter 130 according to some embodiments. In FIG. 7, upper side frames 332B of the supporter 330 are extended in a rounded or curved line. In this configuration, a top frame 336 can be placed closer to the outlet openings 172 formed in the heater body 170 when the supporter 330 is in its assembled position with the reservoir 110. Therefore, it is possible to maintain uniform or similar distances between the outlet openings 172 and the absorbent member 120 supported on the upper portion of the supporter 330.

Figure 8:
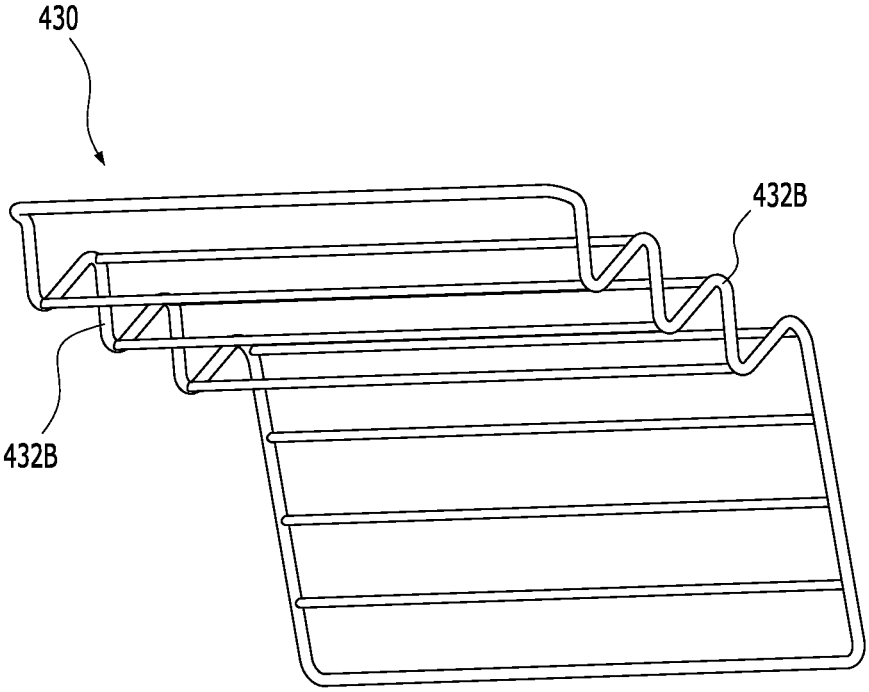
FIG. 8 is a perspective view showing still another alternative supporter of an exemplary humidifier according to some embodiments.
Figure 9A:
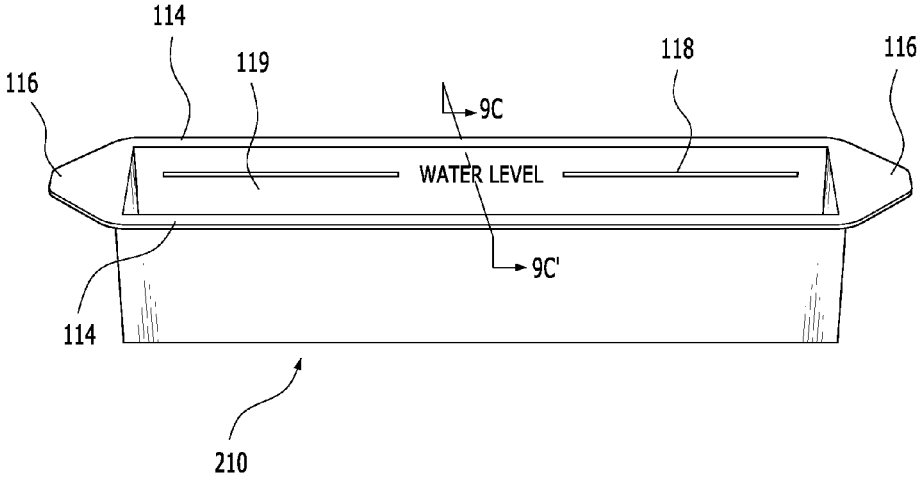
FIG. 9A is a perspective view showing a reservoir of an exemplary humidifier according to some embodiments.
Figure 9B:
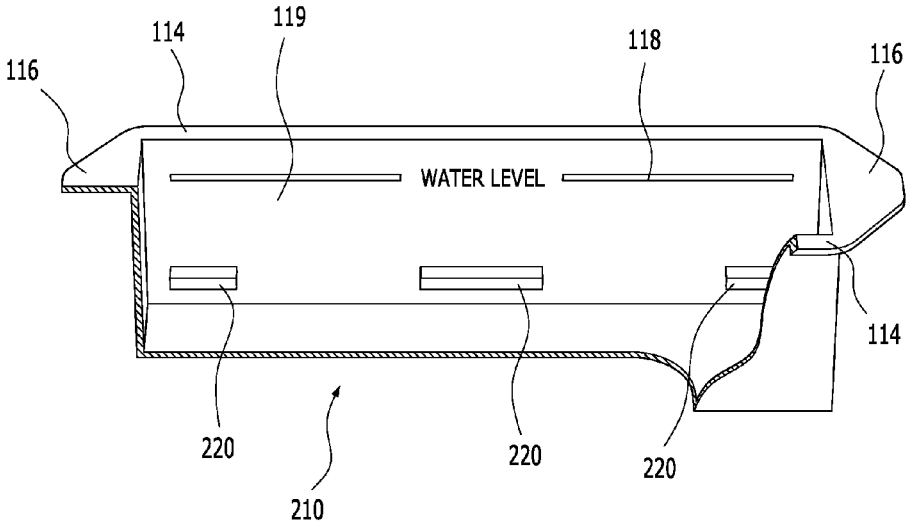
FIG. 9B is a partial cutaway perspective view of the reservoir illustrated in FIG. 9A.
Figure 9C:
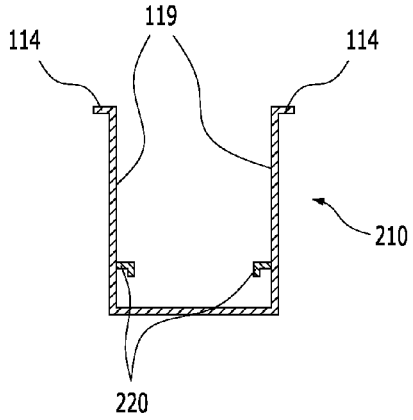
FIG. 9C is a sectional view taken along a line 9C-9C' in FIG. 9A.
Figure 9D:
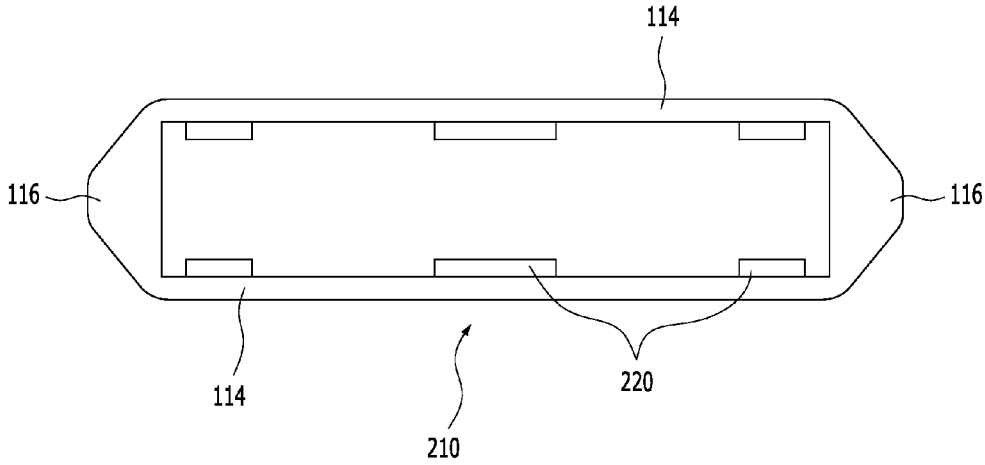
FIG. 9D is a plan view of the reservoir illustrated in FIG. 9A.

FIG. 8 illustrates a supporter 430 as still another alternative example of the supporter 130 according to some embodiments. In FIG. 8, upper side frames 432B of the supporter 430 may be formed in a zigzag or serpentine configuration. In this configuration, top surfaces of the upper side frames 432B have a rough or uneven contour by means of the zigzag shape of the upper side frames 432B. Therefore, when the absorbent member 120 is spread on the supporter 430, the absorbent member 120 can deform along the contours of the top surfaces of the upper side frames 432B to be alternatively folded, and form an uneven sheet having a corrugated shape. As a result, a relatively large sized absorbent member can be used as the absorbent member 120, and therefore relatively large surface area for humidifying can be obtained.

FIGS. 9A-9D illustrate a reservoir 210 as an alternative example of the reservoir 110 shown in FIGS. 1-3. The reservoir 210 has the hook members 220 for engaging the supporter 130 in order to catch the supporter 130 inside the reservoir 210. For instance, in case that the supporter 130 is made of material, which has a lower specific gravity than the liquid, e.g. the plastic material, the supporter 130 can be prevented from floating on the liquid by virtue of the hook member 220. The hook members 220 protrude from a lower portion of the inner wall 119 of the reservoir 110. The number of the hook members 220 and widths of the hook members 220 can be selected as needed. According to some embodiments, the hook members 220 are formed on opposite inner walls facing to each other so as to be symmetrical to each other. By virtue of this symmetrical configuration, the supporter 130 can be assembled with the reservoir 110 by engaging the bottom frame 134 of the supporter 130 with the hook members 220 even when the front and the rear sides of the inner wall 119 of the reservoir 110 are reversely retained by the retainer 160.

The hook members 220 can be formed simultaneously with the forming of the reservoir 110 for example via an injection molding process when the reservoir 110 and the hook members 220 are made of a plastic material. Alternatively, the hook members 220 may be attached to the inner sidewalls of the reservoir 110 via a chemical bonding process using adhesives or a thermal bonding process.

Figure 10A:
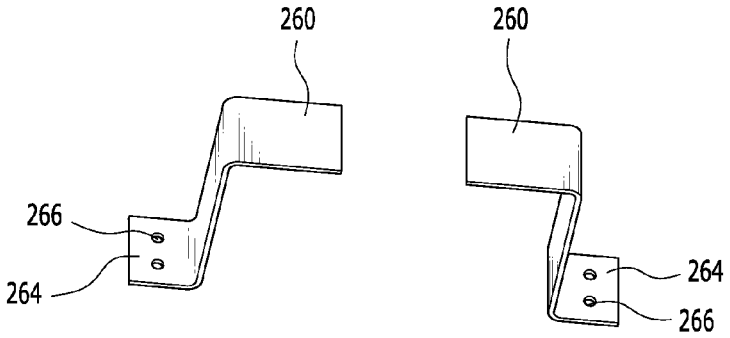
FIG. 10A is a perspective view of an alternative example of a retainer of an exemplary humidifier according to some embodiments.
Figure 10B:
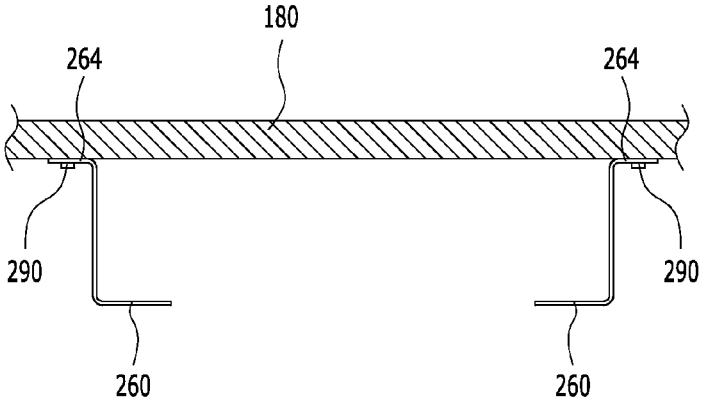
FIG. 10B is a plan view of the retainer depicted in FIG. 10A disposed in an operative position.
Figure 10C:
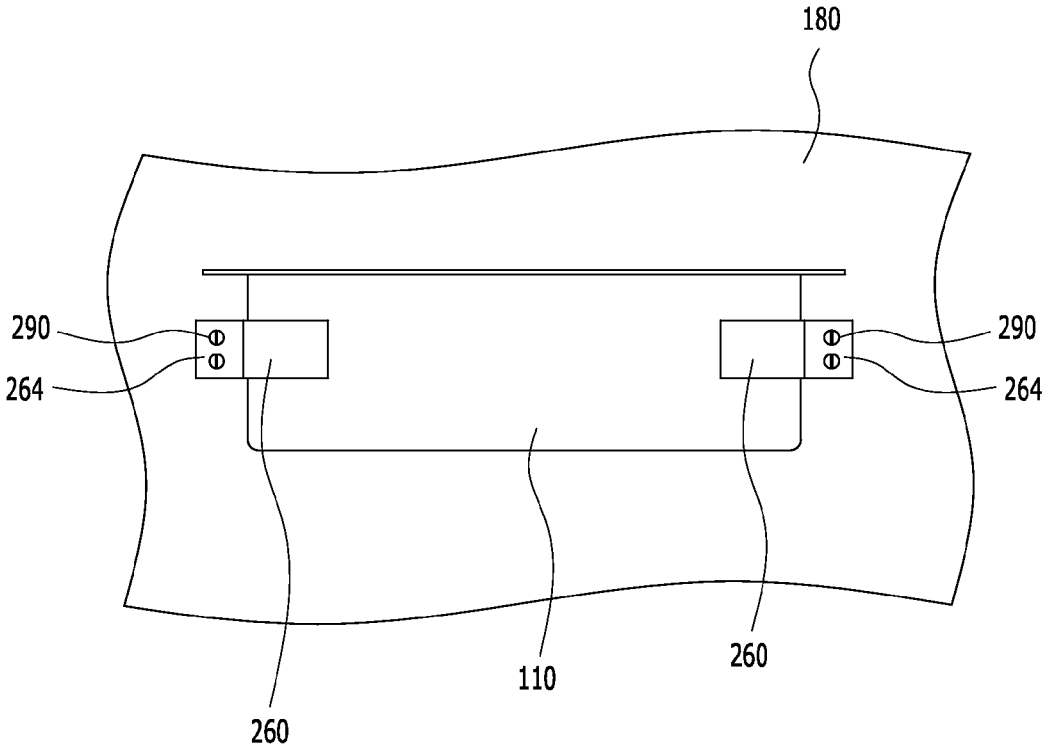
FIG. 10C is a front view of the retainer shown in FIG. 10B supporting an example of the reservoir in an operative position.

FIGS. 10A-10C illustrate a pair of support frame pieces 260 as an alternative example of the retainer 160 according to some embodiments. The pair of support frame pieces 260 can retain the reservoir 110 at both sides of the reservoir 110 as illustrated in FIG. 10C. The pair of support frame pieces 260 has fixing ends 264. The pair of support frame pieces 260 may support the reservoir 110 at a predetermined level of the vertical wall 180 of the room. The pair of support frame pieces 260 may be fixed to the vertical wall 180 by means of the fixing ends 264. The fixing ends 264 have holes 266 formed therein. The pair of support frame pieces 260 may be fixed to the vertical wall 180 by tightening fixing devices 290, for example screws through the holes 266 as shown in FIGS. 10B and 10C. In some embodiments, the pair of support frame pieces 260 may be made of metal or plastic material.

The humidifier according to the aforementioned embodiments can be arranged with an existing heater such as a baseboard radiator, and can be installed in association with a vertical wall adjacent to the heater. The humidifier according to the aforementioned embodiments does not require connection with a separate electric power source for humidifying air but includes a reservoir containing liquid appointed to be placed in proximate association with the heater. The liquid in the reservoir is absorbed by an absorbent member due to capillary action in a state where a part of the absorbent member is dipped into the liquid. The liquid absorbed in the absorbent member can naturally evaporate from the surface of the absorbent member by convection of heated air, and humidify the room. Here, the air convection can be promoted by the heat discharged from an outlet opening of the heater. Therefore, evaporation of the liquid from the absorbent member can more actively occur, and in turn circulation of the liquid absorbed into the absorbent member by capillary action works effectively, by which rapid humidifying is possible and the humidifying capability can be further improved and proper amount of humidity can be maintained. Accordingly, it is possible to provide an energy efficient, economical and cost-effective humidifier.

Further, by having the structure that the absorbent member is free to attach to and detach from the reservoir along with a supporter and the reservoir is free to insert into or remove from a retainer, it is possible to achieve lower maintenance costs and easy maintenance operations such as replacement of the absorbent member and cleaning of the reservoir on a daily basis. Therefore, it is possible to use the humidifier for a long time while maintaining sanitary conditions. Further, the humidifier according to the aforementioned embodiments can eliminate the problem with mold, bacteria, white dust, and mineral impurity.

While the inventive concept has been particularly shown and described with reference to example embodiments thereof, it will be understood that various changes in form and details may be made therein without departing from the spirit and scope of the following claims.

What is claimed is:

1. A natural evaporation type humidifier, comprising:

a reservoir configured to contain liquid;

an absorbent member configured to absorb the liquid in the reservoir by capillary action; and a supporter configured to support the absorbent member, the supporter being detachably assembled with the reservoir and having a portion extending away from the reservoir to guide the absorbent member to a position outside the reservoir, wherein the supporter comprises a pair of side frames extending from inside the reservoir to outside the reservoir when the supporter is disposed in an assembled position with the reservoir, and wherein each of the side frames comprises:

a lower side frame extending within the reservoir along a first direction and comprising a first end supported by an inner bottom portion of the reservoir and a second end supported by a top portion of the reservoir, when the supporter is in the assembled position;

an upper side frame disposed outside the reservoir, extending along a second direction different from the first direction and comprising a first end supported by the top portion of the reservoir and a second end extended out from the reservoir, when the supporter is in the assembled position; and a bent portion connecting the second end of the lower side frame and the first end of the upper side frame.

2. The natural evaporation type humidifier of claim 1, further comprising a retainer configured to retain the reservoir in a predetermined position.

3. The natural evaporation type humidifier of claim 2, wherein the retainer includes:

a belt portion configured to hold the reservoir; and fixing ends connected to the belt portion, and configured to fix the belt portion to a vertical wall.

4. The natural evaporation type humidifier of claim 3, wherein the retainer further comprises a fixing device configured to fix the fixing ends to the vertical wall.

5. The natural evaporation type humidifier of claim 2, wherein the retainer includes a pair of support frame pieces configured to hold the reservoir, and wherein the support frame pieces having fixing ends, and configured to fix the support frame pieces to a vertical wall.

6. The natural evaporation type humidifier of claim 1, wherein a portion of the supporter is configured to be held in a tilted position within the reservoir when the supporter is disposed in an assembled position with the reservoir.

7. The natural evaporation type humidifier of claim 1, wherein the upper side frame is extended in a straight line, in a curved line, or in a zigzag line.

8. The natural evaporation type humidifier of claim 1, wherein the supporter further includes a plurality of guide wires configured to support and guide the absorbent member, the plurality of guide wires extending between the side frames.

9. The natural evaporation type humidifier of claim 8, wherein at least one of the plurality of guide wires is extended in a straight line or in a zigzag line.

10. The natural evaporation type humidifier of claim 1, wherein the supporter includes a bottom frame configured to rest against an inner wall of the reservoir when the supporter is in an assembled position, and a part of the absorbent member is pinched between the bottom frame and the inner wall of the reservoir when the supporter is in the assembled position.

11. The natural evaporation type humidifier of claim 1, wherein the reservoir is made of at least one of glass, metals, plastics, or ceramic materials.

12. The natural evaporation type humidifier of claim 1, wherein the absorbent member is a flexible water absorbent sheet made of at least one of natural fabrics, synthetic fabrics, synthetic resin, non-woven fabrics, or paper.

13. An air control device, comprising:

a natural evaporation type humidifier; and a heater configured to generate heat, wherein the humidifier comprises:

a reservoir configured to contain, the reservoir being positioned on the heater;

an absorbent member configured to absorb the liquid in the reservoir by capillary action; and a supporter configured to support the absorbent member, the supporter being detachably assembled with the reservoir and having a portion extending away from the reservoir to guide the absorbent member to face the heater at a location outside the reservoir, wherein the supporter comprises a pair of side frames extending from inside the reservoir to outside the reservoir when the supporter is disposed in an assembled position with the reservoir, and wherein each of the side frames comprises:

a lower side frame extending within the reservoir along a first direction and comprising a first end supported by an inner bottom portion of the reservoir and a second end supported by a top portion of the reservoir, when the supporter is in the assembled position;

an upper side frame disposed outside the reservoir, extending along a second direction different from the first direction and comprising a first end supported by the top portion of the reservoir and a second end extended out from the reservoir, when the supporter is in the assembled position; and a bent portion connecting the second end of the lower side frame and the first end of the upper side frame.

14. The air control device of claim 13, wherein:

the heater has a heater body and an outlet opening formed in the heater body and configured to discharge heated air from the heater body, the supporter has a plurality of guide wires configured to support and guide the absorbent member, and at least one of the plurality of guide wires faces the outlet opening with a predetermined distance therebetween when the supporter is in its assembled position.

15. The air control device of claim 13, wherein the pair of side frames have portions extended in a straight line, in a curved line, or in a zigzag line.

16. The air control device of claim 14, wherein the absorbent member is configured to face the outlet opening of the heater when the supporter is in an assembled position and the absorbent member is supported on the at least one of the plurality of the guide wires.

17. The air control device of claim 13, wherein the humidifier further comprises a retainer configured to retain the reservoir in a predetermined position.

18. An air control device, comprising:

means for generating heat;

means for containing liquid, the containing means being placed on the heat generating means;

means for absorbing the liquid in the containing means by capillary action; and means for supporting the absorbing means, the supporting means being detachably assembled with the containing means and having a portion extending away from the containing means to guide the absorbing means to face the heat generating means at a location outside the containing means, and wherein the supporting means comprises a pair of side frames extending from inside the containing means to outside the containing means when the supporting means is disposed in an assembled position with the containing means, and wherein each of the side frames comprises:

a lower side frame extending within the containing means along a first direction and comprising a first end supported by an inner bottom portion of the containing means and a second end supported by a top portion of the containing means, when the supporter is in the assembled position;

an upper side frame disposed outside the containing means, extending along a second direction different from the first direction and comprising a first end supported by the top portion of the containing means and a second end extended out from the containing means, when the supporting means is in the assembled position; and a bent portion connecting the second end of the lower side frame and the first end of the upper side frame.

19. The natural evaporation type humidifier of claim 1, wherein the reservoir comprises at least one hook member configured to engage with the lower side frame to catch the supporter in the assembled position with the reservoir, the at least one hook member protrudes from a lower portion of an inner wall of the reservoir.

20. The air control device of claim 13, wherein the reservoir comprises at least one hook member configured to engage with the lower side frame to catch the supporter in the assembled position with the reservoir, the at least one hook member protrudes from a lower portion of an inner wall of the reservoir.

* * * * *